US011414719B2

(12) United States Patent
Eguchi et al.

(10) Patent No.: US 11,414,719 B2
(45) **Date of Patent: *Aug. 16, 2022**

(54) HIGH STRENGTH STAINLESS STEEL SEAMLESS PIPE FOR OIL COUNTRY TUBULAR GOODS

(71) Applicant: JFE STEEL CORPORATION, Tokyo (JP)

(72) Inventors: Kenichiro Eguchi, Tokyo (JP); Yasuhide Ishiguro, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 54 days.

This patent is subject to a terminal disclaimer.

(21) Appl. No.: 16/089,198

(22) PCT Filed: Dec. 16, 2016

(86) PCT No.: PCT/JP2016/087596

§ 371 (c)(1),
(2) Date: Sep. 27, 2018

(87) PCT Pub. No.: WO2017/168874

PCT Pub. Date: Oct. 5, 2017

(65) Prior Publication Data

US 2019/0136337 A1 May 9, 2019

(30) Foreign Application Priority Data

Mar. 29, 2016 (JP) ..... JP2016-065840

(51) Int. Cl.

| | |
|---|---|
| ***C21D 6/04*** | (2006.01) |
| ***C21D 9/08*** | (2006.01) |
| ***C21D 6/00*** | (2006.01) |
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |
| ***C22C 38/26*** | (2006.01) |
| ***C22C 38/22*** | (2006.01) |
| ***C22C 38/20*** | (2006.01) |
| ***C22C 38/24*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |

(52) U.S. Cl.

CPC ..... *C21D 9/085* (2013.01); *C21D 6/004* (2013.01); *C21D 6/005* (2013.01); *C21D 6/007* (2013.01); *C21D 6/008* (2013.01); *C21D 8/105* (2013.01); *C21D 9/08* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C21D 2211/008* (2013.01)

(58) Field of Classification Search

CPC ..... C21D 6/004; C21D 6/005; C21D 6/007; C21D 6/008; C21D 8/105; C21D 9/08; C22C 38/001; C22C 38/22; C22C 38/24; C22C 38/26; C22C 38/46; C22C 38/48

USPC ..... 148/327

See application file for complete search history.

(56) References Cited

U.S. PATENT DOCUMENTS

| | | | | |
|---|---|---|---|---|
| 5,778,714 | A | 7/1998 | Katsumura et al. | |
| 7,842,141 | B2 * | 11/2010 | Kimura | C22C 38/46 148/325 |
| 10,876,183 | B2 * | 12/2020 | Eguchi | C22C 38/54 |

(Continued)

FOREIGN PATENT DOCUMENTS

| | | |
|---|---|---|
| CN | 106282845 A | 1/2017 |
| JP | H10-1755 A | 1/1998 |

(Continued)

OTHER PUBLICATIONS

NPL: on-line translation of JP2010242163A, Oct. 2010 (Year: 2010).*

NPL: on-line translation of JP-2015161010-A Sep. 2015 (Year: 2015).*

Dec. 10, 2018 Extended Search Report issued in European Patent Application No. 16897090.3.

(Continued)

*Primary Examiner* — Jie Yang

(74) *Attorney, Agent, or Firm* — RatnerPrestia

(57) ABSTRACT

A high strength stainless steel seamless pipe for oil country tubular goods which is excellent in hot workability, has a high strength, suppresses scattering in the strength, and has excellent carbon dioxide corrosion resistance. The steel pipe has a yield strength of 655 MPa or more, and a chemical composition comprising, by mass %, C: 0.005 to 0.05%, Si: 0.05 to 0.50%, Mn: 0.20 to 1.80%, P: 0.030% or less, S: 0.005% or less, Cr: 12.0 to 17.0%, Ni: 4.0 to 7.0%, Mo: 0.5 to 3.0%, Al: 0.005 to 0.10%, V: 0.005 to 0.20%, Co: 0.01 to 1.0%, N: 0.005 to 0.15%, and O: 0.010% or less with the balance being Fe and inevitable impurities. Cr, Ni, Mo, Cu, and C satisfy a specified expression, and Cr, Mo, Si, C, Mn, Ni, Cu, and N satisfy another specified expression.

5 Claims, No Drawings

(56) References Cited

U.S. PATENT DOCUMENTS

| | | | | |
|---|---|---|---|---|
| 2004/0154706 | A1* | 8/2004 | Buck | C22C 38/02 148/609 |
| 2004/0238079 | A1 | 12/2004 | Kimura et al. | |
| 2006/0060270 | A1* | 3/2006 | Klueh | C21D 1/18 148/609 |
| 2006/0243354 | A1 | 11/2006 | Kimura et al. | |
| 2008/0310990 | A1 | 12/2008 | Kimura et al. | |
| 2015/0047831 | A1* | 2/2015 | Nakatsuka | C22C 38/004 166/242.1 |
| 2015/0315684 | A1 | 11/2015 | Eguchi et al. | |
| 2019/0100821 | A1* | 4/2019 | Eguchi | C21D 9/085 |
| 2019/0368001 | A1* | 12/2019 | Kamo | C22C 38/002 |
| 2019/0376157 | A1* | 12/2019 | Kamo | C22C 38/06 |

FOREIGN PATENT DOCUMENTS

| | | | | |
|---|---|---|---|---|
| JP | 2006-307287 | A | | 11/2006 |
| JP | 4363327 | B2 | | 11/2009 |
| JP | 2010-242163 | A | | 10/2010 |
| JP | 2010242163 | A | * | 10/2010 |
| JP | 2015-110822 | A | | 6/2015 |
| JP | 2015161010 | A | * | 9/2015 |
| WO | 2004/001082 | A1 | | 12/2003 |
| WO | 2005/017222 | A1 | | 2/2005 |
| WO | 2013/146046 | A1 | | 10/2013 |

OTHER PUBLICATIONS

Mar. 21, 2017 International Search Report issued in International Application No. PCT/JP2016/087596.

Jan. 24, 2020 Office Action issued in European Patent Application No. 16 897 090.03.

Jan. 3, 2020 Office Action issued in U.S. Appl. No. 15/743,111.

Apr. 28, 2020 Office Action issued in U.S. Appl. No. 15/743,111.

Apr. 13, 2021 Office Action issued in U.S. Appl. No. 16/487,203.

Boljanovic, V., "Metal Shaping Processes—Casting and Molding; Particulate Processing; Deformation Processes; and Metal Removal," 6.4.1 Pierce and Pilger Rolling Process, Industrial Press, Inc., pp. 141-143, 2010.

Non Final Office Action for U.S. Appl. No. 16/477,393, dated Jul. 19, 2021, 11 pages.

Final Office Action for U.S. Appl. No. 16/487,203, dated Aug. 2, 2021, 18 pages.

* cited by examiner

HIGH STRENGTH STAINLESS STEEL SEAMLESS PIPE FOR OIL COUNTRY TUBULAR GOODS

TECHNICAL FIELD

This application relates to a stainless steel seamless pipe which is suitably used for an oil well of crude oil, a gas well of natural gas (hereinafter referred to simply as "oil country tubular goods") or the like and in particular, to improvements of carbon dioxide corrosion resistance in a very severe corrosive environment containing carbon dioxide ($CO_2$) and a chlorine ion ($Cl^-$) and having an extremely high temperature of 150° C. or higher and stability of yield strength YS at the time of manufacture.

BACKGROUND

In recent years, oil fields, which lie deep in the ground and have never been considered to date, and oil fields and gas fields in a severe corrosive environment, which is called a "sour" environment containing hydrogen sulfide or the like and so forth are being actively developed from the viewpoints of a sharp rise in the price of crude oil and the depletion of petroleum resources which is anticipated in the near future. These oil fields and gas fields are generally found very deep in the ground and in a severely corrosive environment in which the temperature of the atmosphere is high, and $CO_2$ and $Cl^-$ are contained. Steel pipes for oil country tubular goods which are used in such an environment are required to have a quality provided with not only desired high strength but also excellent corrosion resistance.

Hitherto, 13Cr martensitic stainless steel pipes have been widely used as oil country tubular goods to be used for production in an oil field and a gas field in an environment containing carbon dioxide ($CO_2$), a chlorine ion ($Cl^-$), and so on. Furthermore, in recent years, use of an improved 13Cr martensitic stainless steel having a component system of a 13Cr martensitic stainless steel in which the content of C is decreased, whereas the contents of Ni, Mo, and so on are increased is being expanded.

For example, PTL 1 describes an improved 13Cr martensitic stainless steel (steel pipe) in which the corrosion resistance is improved on a 13Cr martensitic stainless steel (steel pipe). The stainless steel (steel pipe) described in PTL 1 is a martensitic stainless steel with excellent corrosion resistance and sulfide stress corrosion cracking resistance, the stainless steel containing C: 0.005 to 0.05%, Si: 0.05 to 0.5%, Mn: 0.1 to 1.0%, P: 0.025% or less, S: 0.015% or less, Cr: 10 to 15%, Ni: 4.0 to 9.0%, Cu: 0.5 to 3%, Mo: 1.0 to 3%, Al: 0.005 to 0.2%, and N. 0.005% to 0.1% in terms of weight %, with the balance being Fe and inevitable impurities, whose Ni equivalent (Nieq) satisfies a relation: $(40C+34N+Ni+0.3Cu-1.1Cr-1.8Mo)\geq-10$, and having a tempered martensite phase, a martensite phase, and a retained austenite phase, in which the sum of the phase fractions of the tempered martensite phase and the martensite phase is 60% or more and 90% or less, with the balance being the retained austenite phase. According to this, the corrosion resistance and the sulfide stress corrosion cracking resistance in a wet carbon dioxide environment and a wet hydrogen sulfide environment are improved.

In addition, PTL 2 describes a stainless steel pipe for oil country tubular goods having a steel composition containing C: 0.05% sir less, Si: 0.50% or less, Mn: 0.20 to 1.80%, P: 0.03% or less, S: 0.005% or less, Cr: 14.0 to 18.0%, Ni:5.0 to 8.0%, Mo: 1.5 to 3.5%, Cu: 0.5 to 3.5%, Al: 0.05% or less, V: 0.20% or less, N: 0.01 to 0.15%, and O: 0.006% or less in terms of mass %, in which Cr, Ni, Mo, Cu, and C satisfy a specified relation, and furthermore, Cr, Mo, Si, C, Mn, Ni, Cu, and N satisfy a specified relation. According to this, a high strength stainless steel pipe for oil country tubular goods with excellent corrosion resistance, which is inexpensive and excellent in hot workability and exhibits excellent carbon dioxide corrosion resistance even in a very severe corrosive environment including $CO_2$, $Cl^-$, and the like, with a high temperature as higher than 180° C., can be given.

In addition, PTL 3 describes a stainless steel for oil country tubular goods. The technology described in PTL 3 is concerned with a stainless steel pipe having a composition containing C: 0.05% or less, Si: 1.0% or less, Mn: 0.01 to 1.0%, P: 0.05% or less, S: less than 0.002%, Cr: 16 to 18%, Mo: 1.8 to 3%, Cu: 1.0 to 3.5%, Ni: 3.0 to 5.5%, Co: 0.01 to 1.0%, Al: 0.001 to 0.1%, O: 0.05% or less, and N: 0.05% or less in terms of mass %, in which Cr, Ni, Mo, and Cu satisfy a specified relation, and Cr, Ni, Mo, and Cu/3 satisfy a specified relation, and preferably having a structure including 10% or more and less than 60% of a ferrite phase, 10% or less of a retained austenite phase, and 40% or more of a martensite phase in terms of a volume fraction. According to this, a high strength of 758 MPa or more in terms of yield strength and excellent high-temperature corrosion resistance are stably obtained.

CITATION LIST

Patent Literature

PTL 1: JP 10-1755 A

PTL 2: Japanese Patent No. 4363327 (WO 2014/001032 A)

PTL WO 2013/146046 A

SUMMARY

Technical Problem

In recent years, following the development of oil fields, gas fields and so on in a severe corrosive environment, steel pipes for oil country tubular goods have been being desired to have not only high strength but also excellent carbon dioxide corrosion resistance in a severe corrosive environment containing $CO_2$ and $Cl^-$ at a high temperature of 150° C. or higher.

However, the technologies described in PTLs 1 to 3 involved such problems that the hot workability was deteriorated, or scattering in the strength was large.

Then, an object of the disclosed embodiments is to solve the foregoing problems of the background art and to provide a stainless steel seamless pipe for oil country tubular goods having excellent hot workability and high strength, in which not only scattering in the strength is suppressed, but also excellent carbon dioxide corrosion resistance is given.

The term "high strength" referred to herein refers to a case of having a strength of 95 ksi (655 MPa) or more in terms of yield strength YS. Although an upper limit value of the yield strength is not particularly limited, it is desirably 1,034 MPa.

In addition, what the hot workability is excellent indicates the matter that a cross section reduction rate in the case when a specimen is heated to 1,250° C., held for 100 seconds, cooled to 1,000° C. at 1° C./sec, held for 10 seconds, and then drawn until breakage occurs is 70% or more.

In addition, what the scattering in strength is suppressed indicates the matter that a difference in the yield strength YS (ΔYS) between two steel pipes obtained under the same conditions, except that a tempering temperature is different from each other by 20° C. in a tempering temperature range where the yield strength YS is 95 ksi (655 MPa) or more is 120 MPa or less In addition, what the carbon dioxide corrosion resistance is excellent indicates the matter that a corrosion rate in the case where a specimen is dipped in a test solution: 20 mass NaCl aqueous solution (liquid temperature: 150° C., a $CO_2$ gas atmosphere at 10 atm) held in an autoclave, and dipping is carried out for a di ping period of 14 days is 0.125 mm/y or less.

Solution to Problem

In order to achieve the foregoing object, the inventors made extensive and intensive investigations regarding any influences of retained austenite against the yield strength YS with respect to stainless steel pipes having various compositions. As a result, it has been found that a high strength stainless steel seamless pipe with not only desired high strength but also excellent carbon dioxide corrosion resistance a corrosive atmosphere containing $CO_2$ and $Cl^-$ can be given by setting the composition of the stainless steel seamless pipe to a composition in which the respective components are set to appropriate ranges; Cr, Ni, Mo, Cu, and C, and furthermore, Cr, Mo, Si, C, Mn, Ni, Cu, and N, are contained so as to satisfy appropriate relational expressions, respectively; and a specified amount of Co is contained.

The disclosed embodiments have been accomplished upon making further investigations based on such a finding. Specifically, the gist of the disclosed embodiments is as follows.

[1] A high strength stainless steel seamless pipe for oil country tubular goods with a yield strength of 655 MPa or more, the stainless steel seamless pipe comprising a composition containing C; 0.005 to 0.05%, Si: 0.05 to 0.50%, Mn: 0.20 to 1.80%, P: 0.030% or less, S: 0.005% or less, Cr: 12.0 to 17.0%, Ni: 4.0 to 7.0%, Mo: 0.5 to 3.0%, Al: 0.005 to 0.10%, V: 0.005 to 0.20%, Co: 0.01 to 1.0%, N: 0.005 to 0.15%, and O: 0.010% or less in terms of mass % with the balance being Fe and inevitable impurities, and satisfying the following expressions (1) and (2):

$$Cr+0.65Ni+0.6Mo+0.55Cu-20C\geq 15.0 \quad (1)$$

$$Cr+Mo+0.3Si-43.5C-0.4Mn-Ni-0.3Cu-9N\leq 11 \quad (2)$$

where Cr, Ni, Mo, Cu, C, Si, Mn, and N are each the content (masse) of each element, and the content of a non-contained element is defined zero.

The high strength stainless steel seamless pipe for oil country tubular goods as set forth in the above [1], further containing, in addition to the composition, one or two selected from Cu: 0.05 to 3.0% and W: 0.1 to 3.0% in terms of mass %.

[3] The high strength stainless steel seamless pipe for oil country tubular goods as set forth in the above [1] or [2], further containing, in addition to the composition, one or two or more selected from. Nb; 0.01 to 0.20%, 0.01 to 0.30%, Zr: 0.01 to 0.20%, B: 0.0005 to 0.01%, REM: 0.0005 to 0.01%, Ca: 0.0005 to 0.01%, 0.02 to 0.20%, Ta: 0.01 to 0.1%, and Mg: 0.002 to 0.01% in terms of mass %.

Advantageous Effects

In accordance with the disclosed embodiments, a martensitic stainless steel seamless pipe, which is excellent in hot workability and excellent in carbon dioxide corrosion resistance in a corrosive environment containing $CO_2$ and $Cl^-$ at a high temperature of 150° C. or higher, and in which scattering in the strength is suppressed with high strength of a yield strength YS being 655 MPa or more, can be produced.

DETAILED DESCRIPTION

The seamless steel pipe of the disclosed embodiments is a high strength stainless steel seamless pipe for oil country tubular goods with a yield strength of 655 MPa or more, the stainless steel seamless pipe having a composition containing C: 005 to 0.05%, Si: 0.05 to 0.50%, Mn: 0.20 to 1.80%, P: 0.030% or less, S: 0.005% or less, Cr: 12.0 to 17.0%, Ni: 4.0 to 7.0%, Mo: 0.5 to 3.0%, Al: 0.005 to 0.10%, V: 0.005 to 0.20%, Co: 0.01 to 1.0%, N: 0.005 to 0.15%, and O: 0.010% or less in terms of mass % with the balance being Fe and inevitable impurities, and satisfying the following expressions (1) and (2):

$$CR+0.65Ni+0.6Mo+0.55Cu-20C\geq 15.0 \quad (1)$$

$$Cr+Mo+0.3Si-43.5C-0.4Mn-Ni-0.3Cu-9N\leq 11 \quad (2)$$

where Cr, Ni, Mo, Cu, C, Si, Mn, and N are each the content (mass %) of each element, and the content of a non-contained element is defined zero.

First of all, the reasons for limiting the composition of the steel pipe of the disclosed embodiments are described. The term "mass %" is hereinafter referred to simply as "%" unless otherwise indicated.

C: 0.005 to 0.050

C is an important element which increases the strength of the martensitic stainless steel. In the disclosed embodiments, in order to secure the desired strength, it is required to contain C of 0.005% or more. On the other hand, when the content of C exceeds 0.05%, the strength is rather lowered. For this reason, in the disclosed embodiments, the content of C is limited to 0.005 to 0.05%. From the viewpoint of carbon dioxide corrosion resistance, the content of C is preferably limited to 0.03% or less. More preferably, the content of C is 0.015% or more, and more preferably, the content of C is 0.025% or less.

Si: 0.05 to 0.50%

Si is an element which functions as a deoxidizer. This effect is obtained when the content of Si is 0.05% or more. On the other hand, when the content of Si exceeds 0.50%, not only the hot workability is deteriorated, but also the carbon dioxide corrosion resistance is deteriorated. For this reason, the content of Si is limited to 0.05 to 0.50%. Preferably, the content of Si is 0.10% or more, and preferably the content of Si is 0.30% or less.

Mn: 0.20 to 1.80%

Mn is an element which increases the strength of the steel, and in the disclosed embodiments, in order to secure the desired strength, it is required to contain. Mn of 0.20% or more. On the other hand, when the content of Mn exceeds 1.80%, the toughness is adversely affected. For this reason, the content of Mn is limited to a range of 0.20 to 1.80%. The content of Mn is preferably 0.25% or more, More preferably, the content of Mn is 0.30% or more. Still more preferably, the content of Mn is 0.35% or more, Preferably, the content of Mn is 1.0% or less. More preferably, the content of Mn is 0.80% or less. Still more preferably, the content of Mn is 0.50% or less.

P: 0.030% or less

P is an element which deteriorates both the carbon dioxide corrosion resistance and the pitting corrosion resistance, and in the disclosed embodiments, is thus desirably decreased in amount as far as possible. However, an extreme decrease of P results in a sharp rise in the manufacture costs. For this reason, the content of P is limited to 0.030% or less as a range where the manufacture can be carried out relatively inexpensively on an industrial scale without resulting in extreme deteriorating of properties. Preferably, the content of P is 0.020% or less.

S: 0.005% or less

S is an element which remarkably deteriorates the hot workability and impairs the stable operation of a pipe manufacture process and thus, is desirably decreased in amount as far as possible. So long as the content of S is 0.005% or less, it becomes possible to achieve the pipe manufacture by a usual process. In view of the foregoing, the content of S is limited to 0.0058 or less. Preferably, the content of is 0.003% or less.

Cr: 12.0 to 17.0%

Cr is an element which forms a protective film to contribute to an improvement in the corrosion resistance. In order to secure the corrosion r resistance at a high temperature, in the disclosed embodiments, it is required to contain Cr of 12.0% or more. On the other hand, when the content of Cr exceeds 17.0%, not only the hot workability is deteriorated, but also the retained austenite is liable to be formed, so that the desired strength is not obtained. For this reason, the content of Cr is limited to 12.0 to 17.0%. Preferably, the content of Cr is 14.0% or more. Preferably, the content of Cr is 16.0% or less. More preferably, the content of Cr is 15.5% or less.

Ni: 4.0 to 7.0%

Ni is an element having a function of strengthening the protective film to improve the corrosion resistance. In addition, Ni forms solid-solution with steel to increase the strength of the steel. Such an effect is obtained when the content of Ni is 4.0% or more. On the other hand, when the content of Ni exceeds 7.0%, the retained austenite is liable to be formed, so that the strength is lowered. For this reason, the content of Ni is limited to 4.0 to 7.0%. Preferably, the content of Ni is 5.5% or more. More preferably, the content of Ni is 5.8% or more. Preferably, the content of Ni is 6.5% or less.

Mo: 0.5 to 3.0%

Mo is an element which increases the resistivity against the pitting corrosion due to $Cl^-$ or low pH, and in the disclosed embodiments, it required to contain Mo of 0.5% or more. When the content of Mo is less than 0.5%, the corrosion resistance in a severe corrosive environment is deteriorated. On the other hand, when the content of Mo exceeds 3.0%, δ-ferrite is formed, resulting in deteriorating of the hot workability and the corrosion resistance. For this reason, the content of Mo is limited to 0.5 to 3.0%. Preferably, the content of Mo is 1.5% or more. Preferably, the content of Mo is 2.5% or less Al: 0.005 to 0.10%

Al is an element which functions as a deoxidizes. This effect is obtained when the content of Al is 0.005% or more. On the other hand, when the content of Al exceeds 0.10%, the amount of an oxide becomes excessive, thereby the toughness being adversely affected. For this reason, the content of Al is limited to 0.005 to 0.10%. Preferably, the content of Al is 0.01% or more. Preferably, the content of Al is 0.03% or less.

V: 0.005 to 0.20%

V is an element which improves the strength of the steel through precipitation strengthening. This effect is obtained when the content of V is 0.005% or more. On the other hand, even when the content of V exceeds 0.20%, the low-temperature toughness is deteriorated. For this reason, the content of V is limited to 0.20% or less. Preferably, the content of V is 0.03% or more. Preferably, the content of V is 0.08% or less.

Co: 0.01 to 1.0%

In the disclosed embodiments, Co is a very important element having an effect for reducing scattering in the retained austenite fraction and reducing scattering (ΔYS) in the yield strength YS. It may be considered that this is caused due to the matter that Co influences both (1) an effect for suppressing a fluctuation of the retained austenite following scattering in a cooling stop temperature at the time of quenching by increasing an Ms point and (2) an effect for suppressing transformation of a part of the martensite phase into the austenite phase at the time of tempering by increasing an $Ac_1$ point. These effects are obtained when the content of Co is 0.01% or more. On the other hand, even when the content of Co exceeds 1.0%, the hot workability is deteriorated. For this reason, the content of Co is limited to 0.01 to 1.0%. Preferably, the content of Co is 0.05% or more. Preferably, the content of Co is 0.15% or less. More preferably, the content of Co is 0.09% or less.

N: 0.005 to 0.15%

N is an element which remarkably improves the pitting corrosion resistance. This effect is obtained when the content of N is 0.005% or more. On the other hand, even when the content of N exceeds 0.15%, the low-temperature toughness is deteriorated. In view of the foregoing, the content of N is limited to 0.005 to 0.15%. Preferably, the content of N is 0.03 to 0.15%. More preferably, the content of Nis 0.054% or more, and still more preferably, the content of N is 0.08% or less.

O (oxygen): 0.010% or less

O (oxygen) exists in the form of an oxide in the steel and adversely affects various properties. For this reason, O is desirably decreased in amount as far as possible. In particular, when the content of O exceeds 0.010%, both the hot workability and the corrosion resistance are remarkably deteriorated. For this reason, the content of O is limited to 0.010% or less. Preferably, the content of O is 0.006% or less. More preferably, the content of O is 0.004% or less.

In addition, in the disclosed embodiments, Cr, Ni, Mo, Cu, and C are contained within the foregoing ranges and so as to satisfy the following expression (1):

$$Cr+0.65Ni+0.6Mo+0.55Cu-20C\geq 15.0 \quad (1)$$

where Cr, Ni, Mo, Cu, and C are each the content (mass %) of each element, and the content of a non-contained element is defined zero.

When the left-hand side value of the expression (1) is less than 15.0, the carbon dioxide corrosion resistance in a high-temperature corrosive environment containing $CO_2$ and $Cl^-$ at a high temperature of 150° C. or higher is deteriorated. For this reason, in the disclosed embodiments, Cr, Ni, Mo, Cu, and C are contained so as to satisfy the expression (1). When the left-hand side value of the expression (1) is 25.0 or more, the Ms point is lowered, whereby the amount of austenite in the steel becomes excessive, and the desired high strength is hardly obtained. For this reason, the left-hand side value of the expression (1) is preferably less than 25.0.

Furthermore, in the disclosed embodiments, Cr, Mo, Si, C, Mn, Ni, Cu, and N are contained so as to satisfy the following expression (2):

$$Cr+Mo+0.3Si-43.5C-0.4Mn-Ni-0.3Cu-9N\leq 11 \quad (2)$$

where Cr, C, Ni, Cu, and N are each the content (mass %) of each element, and the content of a non-contained element is defined zero.

When the left-hand side value of the expression (2) exceeds 11, necessary and sufficient hot workability for tube making of a martensitic stainless steel seamless pipe cannot be obtained, and productivity of the steel pipe is deteriorated. For this reason, in the disclosed embodiments, Cr, Mo, Si, C, Mn, Ni, Cu, and N are contained so as to satisfy the expression (2) When the left-hand side value of the expression (2) is less than 0, the improvement effect of hot workability is saturated, so that the lower limit value of the left-hand side value of the expression (2) is preferably 0.

In the disclosed embodiments, the balance other than the above-described components is composed of Fe and inevitable impurities.

Although the above-described components are basic components, in addition to the foregoing basic composition, one or two selected from Cu: 0.05 to 3.0% and W: 0.1 to 3.0% can be contained as a selective element, if desired. Furthermore, one or two or more selected from Nb: 0.01 to Ti: 0.01 to 0.30%, Zr: 0.01 to 0.20%, B: 0.0005 to 0.01%, REM: 0.0005 to 0.01%, Ca: 0.0005 to 0.01%, Sn: 0.02 to 0.20%, Ta: 0.01 to 0.1%, and Mg: 0.002 to 0.01% can also be contained.

Cu: 0.05 to 3.0%

Cu is an element which strengthens the protective film to enhance the corrosion resistance and can be contained, if desired. Such an effect is obtained when the content of Cu is 0.05% or more. On the other hand, when the content of Cu exceeds 3.0%, the grain boundary precipitation of CuS is resulted therefrom, and the hot workability is deteriorated. For this reason, in the case of containing Cu, the content of Cu is limited to 0.05 to 3.0%. Preferably, the content of Cu is 0.5 or more. Preferably, the content of Cu is 2.5% or less, More preferably, the content of Cu is 0.5% or more, More preferably, the content of Cu is 1.1% or less.

W: 0.1 to 3.0%

W is an element which contributes to an increase of the strength and can be contained, if desired. Such an effect is obtained when the content of W is 0.1% or more. On the other hand, even when the content of W exceeds 3.0%, the effect is saturated. For this reason, in the case of containing W, the content of W is limited to 0.1 to 3.0%. Preferably, the content of W is 0.5% or more. Preferably, the content of W is 1.5% or less.

Nb: 0.01 to 0.20%

Nb is an element which enhances the strength and can be contained, if desired. Such an effect is obtained when the content of Nb is 0.01% or more. On the other hand, even when the content of Nb exceeds 0.20%, the effect is saturated. For this reason, in the case of containing Nb, the content of Nb is limited to 0.01 to 0.20%. Preferably, the content of Nb is 0.07% or more, Preferably, the content of Nb is 0.15% or less.

Ti: 0.01 to 0.30%

Ti is an element which contributes to an increase of the strength and can be contained, if desired. In order to obtain such an effect, the content of Ti is desirably 0.01% or more. On the other hand, even when the content of Ti exceeds 0.30%, the effect is saturated. For this reason, in the case containing Ti, the content of Ti is limited to 0.01 to 0.30%.

Zr: 0.01 to 0.20%

Zr is an element which contributes to an increase of the strength and can be contained, if desired. Such an effect is obtained when the content of Zr is 0.01% or more. On the other hand, even when the content of Zr exceeds 0.20%, the effect is saturated. For this reason, in the case of containing the content of Zr is limited to 0.01 to 0.20%.

B: 0.0005 to 0.01%

B is an element which contributes to an increase of the strength and can be contained, if desired. Such an effect is obtained when the content of B is 0.0005% or more. On the other hand, when the content of B exceeds 0.01%, the hot workability is deteriorated. For this reason, in the case of containing B, the content of B is limited to 0.0005 to 0.01%.

REM: 0.0005 to 0.01%

REM is an element which contributes to an improvement of the corrosion resistance and can be contained, if desired. Such an effect is obtained when the content of REM is 0.0005% or more. On the other hand, even when the content of REM exceeds 0.01%, the effect is saturated, and the effect corresponding to the content cannot be expected, so that such is economically disadvantageous. For this reason, in the case of containing REM, the content of REM is limited to 0.0005 to 0.01%.

Ca: 0.0005 to 0.01%

Ca is an element which contributes to an improvement the corrosion resistance and can be contained, if desired. Such an effect is obtained when the content of Ca is 0.0005% or more. On the other hand, even when the content of Ca exceeds 0.01%, the effect is saturated, and the effect corresponding to the content cannot be expected, so that such is economically disadvantageous. For this reason, in the case of containing Ca, the content of Ca is limited to 0.0005 to 0.01%.

Sn: 0.02 to 0.20%

Sn is an element which contributes to an improvement of the corrosion resistance and can be contained, if desired. Such an effect is obtained when the content of Sn is 0.02% or more. On the other hand, even when the content of Sn exceeds 0.20%, the effect is saturated, and the effect corresponding to the content cannot be expected, so that such is economically disadvantageous. For this reason, in the case of containing Sn, the content of Sn is limited to 0.02 to 0.20%.

Ta: 0.01 to 0.1%

Ta is an element which increases the strength and has an effect for improving the sulfide stress corrosion cracking resistance. In addition, Ta is an element which brings about the same effect as Nb, and a part of Nb can be replaced by Ta. Such an effect is obtained when the content of Ta is 0.01% or more. On the other hand, when the content of Ta exceeds 0.1%, the toughness is deteriorated. For this reason, in the case of containing Ta, the content of Ta is limited to 0.01 to 0.1%.

Mg: 0.002 to 0.01%

Mg is an element which improves the corrosion resistance and can be contained, if desired. Such an effect is obtained when the content of Mg is 0.002% or more. On the other hand, even when the content of Mg exceeds 0.01%, the effect is saturated, and the effect corresponding to the content cannot be expected. For this reason, in the case of containing Mg, the content of Mg is limited to 0.002 to 0.01%.

In the high strength stainless steel seamless pipe for oil country tubular goods of the disclosed embodiments, in order to secure the desired strength, the martensite phase (tempered martensate phase) is a major phase. The balance other than the major phase is a retained austenite phase or a ferrite phase. Here, the major phase refers to the phase whose volume fraction (area fraction) is 45% or more. In addition, when the volume fraction (area fraction) of the retained austenite phase is 30% or less, the object of the disclosed embodiments can be achieved. In addition, the ferrite phase refers to neither acicular ferrite nor bainitic ferrite but means polygonal ferrite. So far as the volume fraction (area fraction) is concerned, the volume fraction (area fraction) of the ferrite phase is preferably less than 5%, and more preferably 3% or less.

Here, as for the measurement of the above-described structure of the seamless steel pipe of the disclosed embodiments, first, a specimen for structure observation is corroded with a Vilella's reagent (a reagent resulting from mixing picric acid, hydrochloric acid, and ethanol in a proportion of 2 g, 10 mL, and 100 mL, respectively), the resulting structure is photographed with a scanning electron microscope (magnification: 1,000 times), and the structure fraction (volume %) of the ferrite phase is calculated using an image analyzer.

Then, a specimen for X-ray diffraction is prepared by grounding and polishing such that a cross section (C cross section) orthogonal to the pipe axis direction is a measurement surface, and the retained austenite (γ), amount is measured by means of the X-ray diffraction method. Diffraction X-ray integrated intensities of the (220) plane of γ and the (211) plane of α are measured, and the retained austenite amount is calculated according to the following expression.

$$\gamma(\text{volume fraction})=100/(1+(I\alpha R\gamma/I\gamma R\alpha))$$

In the expression, Iα: integrated intensity of α, Rα: crystallographically theoretically calculated value of α, Iγ: integrated intensity of γ, and Rγ: crystallographically theoretically calculated value of γ.

In addition, the fraction of the tempered martensite phase is defined as a balance other than the ferrite phase and the retained γ phase.

Here, the above-described structure of the seamless steel pipe of the disclosed embodiments can be regulated by a heat treatment (quenching treatment and tempering treatment) under specified conditions as described later.

Next, a preferred manufacture method for the high strength stainless steel seamless pipe for oil country tubular goods of the disclosed embodiments is described.

In the disclosed embodiments, the stainless steel seamless pipe having the above-described composition is used as a starting raw material. The manufacture method of the stainless steel seamless pipe as the starting raw material is not necessary to be particularly limited, and any of generally known manufacture methods of a seamless steel pipe are applicable.

It is preferred that a molten steel having the above-described composition is prepared by a usual producing method using a converter or the like and then formed into a steel pipe raw material, such as a billet, etc., by a usual method, such as a continuous casting method, an ingot making-blooming method, etc. Subsequently, the steel pipe raw material is heated and subjected to hot working to achieve tube making by adopting a tube making process of a Mannesmann-plug mill system or a Mannesmann-mandrel mill system that is a usual known tube making method, thereby manufacturing a seamless steel pipe having the above-described composition with a desired dimension. The seamless steel pipe may also be manufactured by means of hot extrusion by a press system. It is preferred that the seamless steel pipe after tube making is cooled to room temperature at a cooling rate of air cooling or more. According to this, a steel pipe structure composed of a martensite phase as a major phase can be secured.

Subsequent to cooling for achieving cooling after tube making to room temperature at a cooling rate of air cooling or more, in the disclosed embodiments, the steel pipe is further reheated at the $Ac_1$ transformation point or higher, preferably a temperature of 800° C. or higher, and then preferably held for 5 minutes or more, and subsequently, the resultant is subjected to a quenching treatment of cooling to a temperature of 100° C. or lower at a cooling rate of air cooling or more. According to this, refining and toughening of the martensite phase can be achieved. From the viewpoint of preventing coarsening of the structure, it is preferred that the heating temperature of the quenching treatment is limited to 800 to 1,000° C.

In addition, the "cooling rate of air cooling or more" referred to here is 0.01° C./s or more.

The steel pipe having been subjected to a quenching treatment is then subjected to a tempering treatment. The tempering treatment is a treatment in which the steel pipe is heated at a temperature (tempering temperature) of 500° C. or higher and lower than the $Ac_1$ transformation point and held for a predetermined time, preferably for 10 minutes or more, followed by performing an air cooling treatment. When the tempering temperature is the $Ac_1$ transformation point or higher, a new martensite phase is precipitated after the tempering, so that the desired toughness cannot be secured. For this reason, it is more preferred that the tempering temperature is limited to 500° C. or higher and lower than the $Ac_1$ transformation point. According to this, the structure becomes a structure composed of the tempered martensite phase as a major phase, and a seamless steel pipe having the desired strength and the desired corrosion resistance is given.

As the above-described $Ac_1$ transformation point and $Ac_1$ transformation point, adopted are actually measured values read out from a change in an expansion rate in the case of performing temperature rising and cooling of a specimen (φ3 mm×L10 mm) at a rate of 15° C./min.

While the disclosed embodiments have been described while referring to the seamless steel pipe as an example, the scope of this disclosure is not intended to be limited to this specific embodiment. It is also possible to provide a steel pipe for oil country tubular goods by manufacturing an electric resistance welded steel pipe or a UOE steel pipe according to a usual process using the steel pipe raw material having the above-described composition.

EXAMPLES

The disclosed embodiments are hereunder further described based on the Examples.

Each molten steel having a composition shown in Table 1 was produced using a converter and then cast into a billet (steel pipe raw material) by the continuous casting method, the billet was subjected to tube making by means of hot working using a model seamless mill, and after the tube making, the resultant was air-cooled to form a seamless steel pipe having an outer diameter of 83.8 mm and a wall thickness of 12.7 mm.

Subsequently, specimen raw materials were respectively cut out from the resulting seemless steel pipes and heated at a heating temperature (reheating temperature) for a soaking time as shown in Table 2, followed by applying a quenching treatment of air cooling at a cooling stop temperature shown in Table 2. Then, the resultants were further subjected to a tempering treatment of performing heating at a tempering temperature for a soaking time and air cooling shown in Table 2.

In addition, a strip specimen specified by API (American Petroleum Institute) standard 5CT was collected from each specimen raw material having been subjected to a quenching-tempering treatment and subjected to a tension test in conformity with the prescriptions of API, thereby determining tension properties (yield strength YS and tensile strength TS). Those showing the yield strength YS of 655 MPa or more were defined as pass, whereas those showing the yield strength YS of less than 655 MPa was defined as reject.

In addition, samples, on which tempering had been separately performed at ±10° C. of each tempering temperature shown in Table 2, were subjected to the same tension test as described above. A value obtained by subtracting the yield strength YS at +10° C. of the tempering temperature from the yield strength YS at −10° C. of the tempering temperature was defined as ΔYS. Those showing the ΔYS of 120 MPa or less were defined as pass, whereas those showing the ΔYS exceeding 120 MPa were defined as reject.

Furthermore, a corrosion specimen of 3 mm in thickness× 30 mm in width×40 mm in length was prepared from each specimen raw material having been subjected to a quenching-tempering treatment by means of mechanical working, and a corrosion test was carried out.

The corrosion test was carried out in such a manner that the specimen was dipped in a test solution: 20 mass % NaCl aqueous solution (liquid temperature: 150° C., a $CO_2$ gas atmosphere at 10 atm) held in an autoclave, and dipping was carried out for a period of 14 days. The specimen after the test was measured with respect to a weight, and a corrosion rate, which was calculated from a weight loss produced between before and after the corrosion test, was determined. Those showing the corrosion rate of 0.125 mm/y or less were defined as pass, whereas those showing the corrosion rate exceeding 0.125 mm/y were defined as reject.

In addition, with respect to each specimen after the corrosion test, the presence or absence of the generation of pitting corrosion on the specimen surface was observed using a loupe with a magnification of 10 times. The case where the pitting corrosion having a pit with a diameter of 0.2 mm or more judged such that the pitting corrosion is present, and then the cases where the pitting corrosion was not generated were defined as pass, whereas the cases where the pitting corrosion was generated were defined as reject.

For the evaluation of hot workability, a smooth specimen having a round bar shape having a parallel part diameter of 10 mm was prepared and heated at 1,250° C. using a Gleeble testing machine; after holding for 100 seconds, the resultant was cooled to 1,000° C. at 1° C./sec and held for 10 seconds, followed drawing until breakage, thereafter a cross section reduction rate being measured. The cases where the cross section reduction rate was 70% or more were considered to have excellent hot workability and defined as pass. On the other hand, the cases where the cross section reduction rate was less than 70% were defined as reject. The obtained results are shown in Table 3.

TABLE 1

| Steel | Component composition (mass %) | | | | | | | | | | | |
|---|---|---|---|---|---|---|---|---|---|---|---|---|
| No. | C | Si | Mn | P | S | Cr | Ni | Mo | Al | V | Co | N |
| A | 0.019 | 0.28 | 0.46 | 0.022 | 0.0011 | 15.0 | 5.6 | 1.9 | 0.011 | 0.03 | 0.14 | 0.081 |
| B | 0.019 | 0.31 | 0.44 | 0.024 | 0.0010 | 14.8 | 5.5 | 1.8 | 0.011 | 0.04 | 0.92 | 0.082 |
| C | 0.009 | 0.16 | 0.97 | 0.012 | 0.0010 | 12.2 | 4.1 | 1.2 | 0.034 | 0.01 | 0.07 | 0.007 |
| D | 0.022 | 0.22 | 0.47 | 0.009 | 0.0009 | 16.8 | 6.3 | 1.7 | 0.011 | 0.03 | 0.06 | 0.058 |
| E | 0.029 | 0.17 | 0.36 | 0.021 | 0.0011 | 14.5 | 6.1 | 1.9 | 0.009 | 0.04 | 0.05 | 0.069 |
| F | 0.018 | 0.31 | 0.47 | 0.022 | 0.0010 | 14.9 | 5.6 | 1.9 | 0.011 | 0.04 | 0.05 | 0.088 |
| G | 0.014 | 0.19 | 0.36 | 0.019 | 0.0009 | 15.7 | 6.5 | 2.3 | 0.020 | 0.07 | 0.07 | 0.040 |
| H | 0.031 | 0.33 | 0.36 | 0.020 | 0.0011 | 16.5 | 7.0 | 1.7 | 0.009 | 0.08 | 0.05 | 0.029 |
| I | 0.019 | 0.24 | 0.45 | 0.009 | 0.0010 | 16.8 | 6.2 | 1.7 | 0.011 | 0.04 | 0.06 | 0.064 |
| J | 0.033 | 0.25 | 0.39 | 0.009 | 0.0010 | 16.9 | 6.6 | 1.6 | 0.018 | 0.04 | 0.05 | 0.117 |
| K | 0.008 | 0.18 | 0.70 | 0.008 | 0.0010 | 13.3 | 5.9 | 1.5 | 0.020 | 0.02 | 0.07 | 0.011 |
| L | 0.010 | 0.17 | 0.86 | 0.012 | 0.0009 | 12.1 | 4.8 | 2.1 | 0.029 | 0.01 | 0.06 | 0.008 |
| M | 0.014 | 0.32 | 0.41 | 0.009 | 0.0009 | 14.6 | 5.2 | 0.6 | 0.011 | 0.07 | 0.05 | 0.063 |
| N | 0.011 | 0.15 | 1.68 | 0.011 | 0.0009 | 12.1 | 4.7 | 2.0 | 0.031 | 0.01 | 0.06 | 0.007 |
| O | 0.030 | 0.29 | 0.36 | 0.019 | 0.0009 | 16.7 | 7.0 | 1.8 | 0.010 | 0.14 | 0.07 | 0.030 |
| P | 0.022 | 0.21 | 0.37 | 0.021 | 0.0011 | 14.7 | 5.9 | 1.9 | 0.010 | 0.04 | 0.07 | 0.054 |
| Q | 0.020 | 0.19 | 0.37 | 0.021 | 0.0010 | 14.4 | 6.1 | 1.8 | 0.010 | 0.04 | 0.05 | 0.068 |
| R | 0.026 | 0.20 | 0.33 | 0.021 | 0.0010 | 14.9 | 6.3 | 1.9 | 0.009 | 0.04 | 0.05 | 0.047 |
| S | 0.017 | 0.29 | 0.46 | 0.024 | 0.0010 | 15.0 | 5.7 | 1.8 | 0.011 | 0.04 | 0.63 | 0.084 |
| T | 0.016 | 0.29 | 0.46 | 0.020 | 0.0010 | 14.8 | 4.3 | 1.9 | 0.010 | 0.05 | 0.05 | 0.106 |
| U | 0.013 | 0.18 | 0.34 | 0.021 | 0.0009 | 15.9 | 6.8 | 2.7 | 0.018 | 0.07 | 0.07 | 0.048 |
| V | 0.055 | 0.24 | 0.45 | 0.009 | 0.0010 | 16.9 | 6.7 | 1.5 | 0.019 | 0.05 | 0.06 | 0.101 |
| W | 0.029 | 0.35 | 0.33 | 0.022 | 0.0012 | 16.7 | 7.3 | 1.7 | 0.010 | 0.09 | 0.05 | 0.034 |
| X | 0.018 | 0.28 | 0.50 | 0.021 | 0.0010 | 14.4 | 3.8 | 1.9 | 0.011 | 0.05 | 0.05 | 0.079 |
| Y | 0.017 | 0.30 | 0.44 | 0.022 | 0.0009 | 15.2 | 5.4 | 1.8 | 0.011 | 0.04 | 1.14 | 0.100 |
| Z | 0.006 | 0.21 | 0.64 | 0.008 | 0.0009 | 13.0 | 6.2 | 1.5 | 0.018 | 0.02 | — | 0.008 |
| AA | 0.026 | 0.17 | 0.89 | 0.012 | 0.0011 | 12.2 | 4.2 | 0.7 | 0.030 | 0.01 | 0.06 | 0.007 |
| AB | 0.016 | 0.15 | 0.38 | 0.021 | 0.0010 | 16.4 | 5.2 | 2.4 | 0.023 | 0.07 | 0.07 | 0.038 |
| AC | 0.056 | 0.24 | 0.42 | 0.010 | 0.0010 | 16.9 | 6.4 | 1.6 | 0.020 | 0.04 | 0.05 | 0.112 |
| AD | 0.010 | 0.17 | 1.03 | 0.012 | 0.0010 | 12.1 | 3.9 | 2.1 | 0.031 | 0.01 | 0.07 | 0.007 |
| AE | 0.015 | 0.16 | 0.35 | 0.020 | 0.0010 | 15.3 | 6.4 | 2.3 | 0.021 | 0.06 | — | 0.043 |
| AF | 0.007 | 0.21 | 0.66 | 0.008 | 0.0010 | 13.1 | 6.4 | 1.5 | 0.018 | 0.02 | — | 0.008 |
| AG | 0.016 | 0.16 | 0.89 | 0.012 | 0.0010 | 12.1 | 4.0 | 0.7 | 0.029 | 0.01 | 0.06 | 0.008 |
| AH | 0.015 | 0.17 | 0.40 | 0.020 | 0.0010 | 16.2 | 5.2 | 2.5 | 0.021 | 0.07 | 0.07 | 0.037 |
| AI | 0.020 | 0.22 | 0.45 | 0.009 | 0.0009 | 16.6 | 6.1 | 1.6 | 0.011 | 0.04 | 0.02 | 0.068 |

TABLE 1-continued

| Steel No. | Component composition (mass %) O | Left-hand side of expression (1)*1 | Left-hand side of expression (2)*2 | Selective addition | Remark |
|---|---|---|---|---|---|
| A | 0.0012 | 19.4 | 9.6 | — | Example |
| B | 0.0012 | 19.1 | 9.5 | — | Example |
| C | 0.0033 | 15.4 | 8.5 | — | Example |
| D | 0.0014 | 21.5 | 10.6 | — | Example |
| E | 0.0020 | 19.4 | 8.1 | Cu: 0.7, Nb: 0.06 | Example |
| F | 0.0012 | 19.7 | 9.3 | Cu: 0.7 | Example |
| G | 0.0055 | 21.7 | 10.1 | Cu: 1.3, Nb: 0.04, Ti: 0.083, B: 0.001 | Example |
| H | 0.0030 | 21.8 | 9.4 | Cu: 0.6, Nb: 0.08, Ti: 0.041, Ca: 0.003 | Example |
| I | 0.0017 | 22.0 | 10.5 | Cu: 0.9, Nb: 0.10, Ti: 0.040, W: 0.20 | Example |
| J | 0.0027 | 22.1 | 9.1 | Cu: 0.7, Ti: 0.173, Zr: 0.08, Ca: 0.001 | Example |
| K | 0.0030 | 18.5 | 7.9 | Cu: 1.1, Ti: 0.084, Zr: 0.02, REM: 0.003 | Example |
| L | 0.0027 | 16.3 | 8.6 | Ti: 0.107, Zr: 0.02, Ta: 0.03, Ca: 0.003, Mg: 0.003 | Example |
| M | 0.0031 | 18.4 | 8.5 | Cu: 0.7 | Example |
| N | 0.0032 | 16.1 | 8.2 | Ti: 0.093 | Example |
| O | 0.0027 | 22.1 | 9.7 | Cu: 0.6, Nb: 0.08, Ti: 0.037 | Example |
| P | 0.0016 | 19.2 | 9.2 | Nb: 0.06 | Example |
| Q | 0.0017 | 19.0 | 8.5 | Nb: 0.06, Ca: 0.0029, REM: 0.0034 | Example |
| R | 0.0023 | 19.9 | 8.7 | Cu: 0.6, Nb: 0.09, Ca: 0.0036, REM: 0.0034 | Example |
| S | 0.0012 | 19.4 | 9.5 | Sn: 0.11 | Example |
| T | 0.0013 | 18.8 | 10.4 | Cu: 0.7 | Example |
| U | 0.0054 | 22.3 | 10.4 | Cu: 1.2, Nb: 0.04, Ti: 0.090 | Example |
| V | 0.0032 | 21.1 | 8.3 | — | Comparative Example |
| W | 0.0033 | 21.9 | 9.5 | — | Comparative Example |
| X | 0.0011 | 17.7 | 10.9 | — | Comparative Example |
| Y | 0.0010 | 19.5 | 9.9 | — | Comparative Example |
| Z | 0.0029 | 17.8 | 7.8 | — | Comparative Example |
| AA | 0.0033 | 14.8 | 7.2 | — | Comparative Example |
| AB | 0.0042 | 20.9 | 12.5 | — | Comparative Example |
| AC | 0.0033 | 20.9 | 8.3 | Cu: 0.8, Ti: 0.167 | Comparative Example |
| AD | 0.0028 | 15.7 | 9.4 | Ti: 0.106 | Comparative Example |
| AE | 0.0042 | 21.3 | 9.7 | Cu: 1.3, Nb: 0.03, Ti: 0.084 | Comparative Example |
| AF | 0.0028 | 18.6 | 7.3 | Cu: 1.1, Ti: 0.067 | Comparative Example |
| AG | 0.0035 | 14.8 | 7.7 | Ti: 0.105 | Comparative Example |
| AH | 0.0050 | 21.5 | 12.0 | Cu: 1.3, Nb: 0.04, Ti: 0.064, B: 0.001 | Comparative Example |
| AI | 0.0012 | 21.1 | 10.5 | — | Example |

The balance other than the above-described components is Fe and inevitable impurities.

*1Left-hand side of expression (1) = Cr + 0.65Ni + 0.6Mo + 0.55Cu − 20C

*2Left-hand side of expression (2) = Cr + Mo + 0.3Si − 43.3 C − 0.4Mn − Ni − 0.3Cu − 9N

TABLE 2

| | | | | Heat treatment | | | | | | |
|---|---|---|---|---|---|---|---|---|---|---|
| | | | | Quenching | | | | Tempering | | |
| Steel pipe No. | Steel No. | $Ac_1$ (° C.) | $Ac_3$ (° C.) | Heating temperature (° C.) | Soaking time (min) | Cooling | Cooling stop temperature (° C.) | Tempering temperature (° C.) | Soaking time (min) | Cooling |
| 1 | A | 732 | 852 | 890 | 20 | Air cooling | 30 | 530 | 20 | Air cooling |
| 2 | B | 725 | 873 | 890 | 20 | Air cooling | 30 | 530 | 20 | Air cooling |
| 3 | C | 625 | 755 | 850 | 20 | Air cooling | 25 | 600 | 40 | Air cooling |
| 4 | D | 789 | 884 | 960 | 20 | Air cooling | 30 | 580 | 20 | Air cooling |
| 5 | E | 686 | 799 | 890 | 20 | Air cooling | 30 | 530 | 20 | Air cooling |
| 6 | F | 744 | 849 | 890 | 20 | Air cooling | 30 | 530 | 20 | Air cooling |
| 7 | G | 800 | 918 | 960 | 20 | Air cooling | 30 | 580 | 20 | Air cooling |
| 8 | H | 812 | 890 | 920 | 20 | Air cooling | 30 | 580 | 20 | Air cooling |
| 9 | I | 802 | 919 | 960 | 20 | Air cooling | 30 | 580 | 20 | Air cooling |
| 10 | J | 812 | 910 | 920 | 20 | Air cooling | 30 | 580 | 20 | Air cooling |
| 11 | K | 618 | 785 | 810 | 20 | Air cooling | 25 | 600 | 40 | Air cooling |
| 12 | L | 628 | 808 | 810 | 20 | Air cooling | 25 | 600 | 40 | Air cooling |
| 13 | M | 717 | 828 | 920 | 20 | Air cooling | 30 | 600 | 20 | Air cooling |
| 14 | N | 554 | 736 | 810 | 20 | Air cooling | 25 | 550 | 40 | Air cooling |
| 15 | O | 826 | 906 | 920 | 20 | Air cooling | 30 | 580 | 20 | Air cooling |
| 16 | P | 713 | 802 | 890 | 20 | Air cooling | 30 | 530 | 20 | Air cooling |
| 17 | Q | 716 | 808 | 890 | 20 | Air cooling | 30 | 530 | 20 | Air cooling |
| 18 | R | 695 | 806 | 890 | 20 | Air cooling | 30 | 530 | 20 | Air cooling |
| 19 | S | 750 | 833 | 890 | 20 | Air cooling | 30 | 530 | 20 | Air cooling |
| 20 | T | 807 | 908 | 930 | 20 | Air cooling | 30 | 530 | 20 | Air cooling |
| 21 | U | 799 | 889 | 960 | 20 | Air cooling | 30 | 580 | 20 | Air cooling |
| 22 | V | 795 | 907 | 920 | 20 | Air cooling | 30 | 580 | 20 | Air cooling |
| 23 | W | 809 | 853 | 920 | 20 | Air cooling | 30 | 580 | 20 | Air cooling |
| 24 | X | 804 | 903 | 910 | 20 | Air cooling | 30 | 530 | 20 | Air cooling |
| 25 | Y | 761 | 899 | 910 | 20 | Air cooling | 30 | 530 | 20 | Air cooling |
| 26 | Z | 619 | 712 | 810 | 20 | Air cooling | 25 | 600 | 40 | Air cooling |
| 27 | AA | 608 | 737 | 810 | 20 | Air cooling | 25 | 600 | 40 | Air cooling |
| 28 | AB | 802 | 904 | 920 | 20 | Air cooling | 30 | 580 | 20 | Air cooling |
| 29 | AC | 816 | 916 | 920 | 20 | Air cooling | 30 | 580 | 20 | Air cooling |
| 30 | AD | 653 | 831 | 850 | 20 | Air cooling | 25 | 600 | 40 | Air cooling |
| 31 | AE | 775 | 902 | 960 | 20 | Air cooling | 30 | 580 | 20 | Air cooling |
| 32 | AF | 611 | 762 | 810 | 20 | Air cooling | 25 | 600 | 40 | Air cooling |
| 33 | AG | 627 | 801 | 810 | 20 | Air cooling | 25 | 600 | 40 | Air cooling |
| 34 | AH | 810 | 910 | 920 | 20 | Air cooling | 30 | 580 | 20 | Air cooling |
| 35 | AI | 789 | 884 | 960 | 20 | Air cooling | 30 | 580 | 20 | Air cooling |

TABLE 3

| | | Hot workability | Tensile properties | | | Corrosion properties | | |
|---|---|---|---|---|---|---|---|---|
| Steel pipe No. | Steel No. | Cross section reduction rate (%) | Yield strength YS (MPa) | Tensile strength TS (MPa) | ΔYS (MPa) | Corrosion rate (mm/y) | Pitting corrosion | Remark |
| 1 | A | 74 | 989 | 1230 | 54 | 0.012 | No | Example |
| 2 | B | 78 | 990 | 1207 | 51 | 0.010 | No | Example |
| 3 | C | 76 | 690 | 896 | 107 | 0.121 | No | Example |
| 4 | D | 76 | 702 | 867 | 50 | 0.009 | No | Example |
| 5 | E | 82 | 925 | 1156 | 46 | 0.011 | No | Example |
| 6 | F | 76 | 1003 | 1208 | 54 | 0.011 | No | Example |
| 7 | G | 87 | 792 | 943 | 50 | 0.009 | No | Example |
| 8 | H | 74 | 687 | 848 | 46 | 0.009 | No | Example |
| 9 | I | 72 | 749 | 948 | 55 | 0.009 | No | Example |
| 10 | J | 78 | 698 | 862 | 54 | 0.01 | No | Example |
| 11 | K | 73 | 724 | 862 | 107 | 0.029 | No | Example |
| 12 | L | 78 | 682 | 802 | 101 | 0.122 | No | Example |
| 13 | M | 83 | 725 | 863 | 98 | 0.008 | No | Example |
| 14 | N | 80 | 820 | 950 | 100 | 0.116 | No | Example |
| 15 | O | 80 | 659 | 810 | 52 | 0.011 | No | Example |
| 16 | P | 86 | 931 | 1164 | 53 | 0.009 | No | Example |
| 17 | Q | 75 | 907 | 1133 | 49 | 0.009 | No | Example |
| 18 | R | 86 | 886 | 1094 | 53 | 0.009 | No | Example |
| 19 | S | 74 | 993 | 1208 | 59 | 0.012 | No | Example |
| 20 | T | 82 | 947 | 1155 | 59 | 0.010 | No | Example |
| 21 | U | 85 | 827 | 996 | 52 | 0.011 | No | Example |
| 22 | V | 84 | 641 | 878 | 52 | 0.008 | No | Comparative Example |
| 23 | W | 75 | 624 | 880 | 49 | 0.009 | No | Comparative Example |
| 24 | X | 74 | 636 | 815 | 47 | 0.020 | Yes | Comparative Example |

TABLE 3-continued

| Steel pipe No. | Steel No. | Hot workability: Cross section reduction rate (%) | Tensile properties: Yield strength YS (MPa) | Tensile properties: Tensile strength TS (MPa) | Tensile properties: ΔYS (MPa) | Corrosion properties: Corrosion rate (mm/y) | Corrosion properties: Pitting corrosion | Remark |
|---|---|---|---|---|---|---|---|---|
| 25 | Y | 60 | 981 | 1196 | 52 | 0.008 | No | Comparative Example |
| 26 | Z | 84 | 743 | 874 | 153 | 0.027 | No | Comparative Example |
| 27 | AA | 78 | 718 | 845 | 119 | 0.180 | No | Comparative Example |
| 28 | AB | 61 | 850 | 1012 | 40 | 0.011 | No | Comparative Example |
| 29 | AC | 87 | 648 | 890 | 49 | 0.008 | No | Comparative Example |
| 30 | AD | 75 | 624 | 810 | 92 | 0.162 | No | Comparative Example |
| 31 | AE | 86 | 841 | 1013 | 146 | 0.011 | No | Comparative Example |
| 32 | AF | 87 | 784 | 933 | 135 | 0.028 | No | Comparative Example |
| 33 | AG | 85 | 667 | 781 | 92 | 0.258 | No | Comparative Example |
| 34 | AH | 67 | 763 | 919 | 48 | 0.012 | No | Comparative Example |
| 35 | AI | 76 | 709 | 865 | 50 | 0.008 | No | Example |

All of the Examples had a yield strength YS of 655 MPa or more and excellent corrosion resistance (carbon dioxide corrosion resistance) in a corrosive environment containing $CO_2$ and CF at a high temperature of 150° C. or higher; and furthermore, even when the tempering temperature was fluctuated by 20° C., they exhibited excellent YS stability such that a change (ΔYS) in the yield strength YS was 120 MPa or less and had a cross section reduction rate of 70% or more. On the other hand, in the Comparative Examples falling out ide the scope of the disclosed embodiments, a desired value was not obtained with respect to at least one of the yield strength YS, the ΔYS, the corrosion rate, and the cross section reduction rate.

In the steel pipe No. 22 (steel No. V) and the steel pipe No. 29 (steel No. AC), the content of C exceeded 0.05 mass %, and the yield strength YS was less than 655 MPa.

In the steel pipe No. 23 (steel No. N), the content of Ni exceeded 7.0 mass %, and the yield strength YS was less than 655 MPa.

In the steel pipe No. 24 (steel No. X), since the content of Ni was less than 4.0 mass, not only the yield strength YS was less than 655 MPa, hut also the pitting corrosion was generated.

In the steel pipe No. 30 (steel No. AD), since the content of Ni was less than 4.0 mass %, not only the yield strength YS was less than 655 MPa, hut also the corrosion rate exceeded 0.125 mm/y.

In the steel pipe No. 25 (steel No. Y), the content of Co exceeded 1.0 mass %, and the cross section reduction rate was less than 70%.

In the steel pipe No. 26 (steel No. Z), the steel pipe No. 31 (steel No. AE), and the steel pipe No. 32 (steel No. AF), Co was not contained, and the ΔYS exceeded 120 MPa.

In the steel pipe No. 27 (steel No AA) and the steel pipe No. 33 (steel No. AG), the left-hand side value of the expression (1) was less than 15.0, and the corrosion rate exceeded 0.125 mm/y.

In the steel pipe No. 28 (steel No. AB) and the steel pipe No. 34 (steel No. AH), the left-hand side value of the expression (2) exceeded 11, and the cross section reduction rate was less than 70%.

The invention claimed is:

1. A high strength stainless steel seamless pipe for oil country tubular goods with a yield strength of 655 MPa or more, the stainless steel seamless pipe having a chemical composition comprising, by mass %:

C: 0.005 to 0.05%;
Si: 0.05 to 0.50%;
Mn: 0.20 to 0.50%;
P: 0.030% or less;
S: 0.005% or less;
Cr: more than 14.0 to 15.9%;
Ni: 4.0 to 7.0%;
Mo: 0.5 to 3.0%;
Al: 0.005 to 0.10%;
V: 0.005 to 0.20%;
Co: 0.01 to 0.92%;
N: 0.005 to 0.15%;
O:0.010% or less;
optionally, Cu: 0.05 to 3.0%; and
the balance being Fe and inevitable impurities,
wherein the following expressions (1) and (2) are satisfied:

$$Cr+0.65Ni+0.6Mo+0.55Cu-20C\geq 15.0 \quad (1)$$

$$Cr+Mo+0.3Si-43.5C-0.4Mn-Ni-0.3Cu-9N\leq 11 \quad (2)$$

where Cr, Ni, Mo, Cu, C, Si, Mn, and N are a content, by mass %, of each respective element, and a content of any non-contained element is zero, and wherein a difference in yield strengths YS (ΔYS) between two specimens of the pipe is 120 MPa or less when the two specimens are obtained under the same conditions except that a tempering temperature is different from each other by 20° C. in a tempering temperature range where the yield strength YS is 95 ksi (655 MPa) or more.

2. The high strength stainless steel seamless pipe for oil country tubular goods according to claim 1, further comprising, by mass %, at least one selected from the group consisting of Cu: 0.05 to 3.0%, and W: 0.1 to 3.0%.

3. The high strength stainless steel seamless pipe for oil country tubular goods according to claim 2, further comprising, by mass %, at least one selected from the group consisting of Nb: 0.01 to 0.20%, Ti: 0.01 to 0.30%, Zr: 0.01 to 0.20%, B: 0.0005 to 0.01%, REM: 0.0005 to 0.01%, Ca: 0.0005 to 0.01%, Sn: 0.02 to 0.20%, Ta: 0.01 to 0.1%, and Mg: 0.002 to 0.01%.

4. The high strength stainless steel seamless pipe for oil country tubular goods according to claim 1, further comprising, by mass %, at least one selected from the group consisting of Nb: 0.01 to 0.20%, Ti: 0.01 to 0.30%, Zr: 0.01 to 0.20%, B: 0.0005 to 0.01%, REM: 0.0005 to 0.01%, Ca: 0.0005 to 0.01%, Sn: 0.02 to 0.20%, Ta: 0.01 to 0.1%, and Mg: 0.002 to 0.01%.

5. The high strength stainless steel seamless pipe for oil country tubular goods according to claim 1, having a cross section reduction rate of 70% or more when a specimen of the pipe is heated to 1,250° C., held for 100 seconds, cooled to 1,000° C. at 1° C./sec, held for 10 seconds, and then drawn until breakage occurs.

* * * * *